US007284933B2

(12) United States Patent
Calandra, Jr. et al.

(10) Patent No.: US 7,284,933 B2
(45) Date of Patent: Oct. 23, 2007

(54) SQUARE EMBOSSED ROOF AND RIB PLATE

(75) Inventors: Frank Calandra, Jr., Pittsburgh, PA (US); Jack R. Eaton, Oakmont, PA (US); John C. Stankus, Canonsburg, PA (US); Eugene H. Stewart, Pittsburgh, PA (US); Demrey G. Brandon, Pittsburgh, PA (US)

(73) Assignee: Jennmar Corporation, Pittsburgh, PA (US)

( * ) Notice: Subject to any disclaimer, the term of this patent is extended or adjusted under 35 U.S.C. 154(b) by 0 days.

(21) Appl. No.: 10/457,840

(22) Filed: Jun. 9, 2003

(65) Prior Publication Data

US 2004/0018062 A1 Jan. 29, 2004

Related U.S. Application Data

(60) Provisional application No. 60/386,939, filed on Jun. 7, 2002, provisional application No. 60/395,112, filed on Jul. 11, 2002.

(51) Int. Cl.
*E02D 29/045* (2006.01)

(52) U.S. Cl. ..... 405/302.1; 411/545; 428/177

(58) Field of Classification Search ..... 405/288, 405/302.1, 259.1, 259.2, 259; 52/408, 410; 411/545, 531; D8/399; 428/582, 595, 599, 428/130, 126, 177; 299/11
See application file for complete search history.

(56) References Cited

U.S. PATENT DOCUMENTS 1,111,034 A * 9/1914 Robertson ..... 411/531
1,320,692 A * 11/1919 Hulse ..... 428/126
1,481,515 A * 1/1924 Kraft ..... 411/545
3,455,053 A * 7/1969 Pembor ..... 446/389
3,464,308 A * 9/1969 Dohmeier ..... 411/437

(Continued)

FOREIGN PATENT DOCUMENTS

DE 29703416 U 4/1997

(Continued)

OTHER PUBLICATIONS

Cover pages and Table of Contents for the 20th International Conference on Ground Control in Mining (Aug. 7-9, 2001); and Tadolini, Stephen C. and Dolinar, Dennis R., "Enhanced Surface Control for Roof and Rib Support," 20th International Conference on Ground Control in Mining, pp. 173-179, (Aug. 7-9, 2001).

*Primary Examiner*—M. Safavi
(74) *Attorney, Agent, or Firm*—The Webb Law Firm

(57) ABSTRACT

Disclosed is a mine roof and rib support system generally including a square bearing plate. A through hole is positioned near a center portion of the square bearing plate. A peripheral section at least partially circumscribes the bearing plate. In between the through hole and the peripheral section is a rib member area. The rib member area may include two rib members with a convex cross-section connected by a substantially linear surface member disposed between the two rib members, two or more concave ribs with a substantially linear surface member disposed between the two rib members, or two substantially linear surfaces connected by a convex rib member. A safety edge surrounds the square bearing plate. The safety edge may be a rolled edge, a looped edge, a folded edge, or another comparable edge. Also disclosed is a method for making the mine roof and rib support system.

21 Claims, 9 Drawing Sheets

U.S. PATENT DOCUMENTS

| | | | | | |
|---|---|---|---|---|---|
| 3,588,787 | A | * | 6/1971 | Bushey et al. | 411/531 |
| D236,428 | S | * | 8/1975 | Stewart et al. | D8/399 |
| 4,112,693 | A | | 9/1978 | Collin et al. | |
| 4,279,966 | A | * | 7/1981 | Wakana et al. | 428/595 |
| D263,928 | S | * | 4/1982 | Dewey | D8/399 |
| 4,371,293 | A | * | 2/1983 | Wilcox et al. | 405/302.1 |
| 4,445,808 | A | | 5/1984 | Arya | |
| 4,498,815 | A | | 2/1985 | Dye | |
| 4,518,282 | A | | 5/1985 | Wilcox et al. | |
| 4,520,606 | A | * | 6/1985 | Francovitch | 52/410 |
| 4,652,178 | A | | 3/1987 | Kates et al. | |
| 4,747,241 | A | * | 5/1988 | Whitman | 411/531 |
| 4,751,802 | A | * | 6/1988 | Whitman | 52/410 |
| 4,780,039 | A | * | 10/1988 | Hartman | 411/531 |
| 4,894,970 | A | * | 1/1990 | Lebraut | 52/410 |
| D310,324 | S | * | 9/1990 | Bernacchi et al. | D8/399 |
| 5,102,275 | A | * | 4/1992 | Hulsey | 411/134 |
| 5,139,379 | A | * | 8/1992 | Hasan et al. | 411/531 |
| 5,445,477 | A | * | 8/1995 | Calandra, Jr. | 411/545 |
| 5,577,609 | A | * | 11/1996 | Hexter, Jr. | 428/542.4 |
| 5,709,059 | A | * | 1/1998 | Murphy et al. | 52/410 |
| 5,794,814 | A | * | 8/1998 | Baerenwald | 220/685 |
| 5,803,693 | A | * | 9/1998 | Choiniere et al. | 411/537 |
| 5,867,958 | A | * | 2/1999 | Ditka et al. | 52/410 |
| 5,934,855 | A | * | 8/1999 | Osterle et al. | 411/545 |
| 6,146,056 | A | | 11/2000 | Calandra, Jr. | |
| 2003/0039514 | A1 | | 2/2003 | Tadolini et al. | |

FOREIGN PATENT DOCUMENTS

| | | |
|---|---|---|
| GB | 2292199 A | 2/1996 |

* cited by examiner

PAN 14" SPAN TEST RESULTS

| TEST DATE | COUNTER NO. | SAMPLE# | PAN TYPE | MAT'L THK. | PEAK LOAD (lbf) | COMMENTS |
|---|---|---|---|---|---|---|
| 5/29/02 | 1155 | 5/29/02-3 | JM 17-13/16" SQUARE (1-3/8" HOLE) VA | 0.034" | 1,167 | 6X6 FLAT PLATE |
| 5/29/02 | 1156 | 5/29/02-4 | JM 17-13/16" SQUARE (1-3/8" HOLE) VA | 0.034" | 1,194 | 6X6 FLAT PLATE |
| 5/29/02 | 1157 | 5/29/02-5 | JM 17-13/16" SQUARE (1-3/8" HOLE) VA | 0.034" | 1,158 | 6X6 FLAT PLATE |
| 6/3/02 | 1161 | 6/3/02-1 | JM 17-7/8" SQUARE (1-3/8" HOLE) VA | 0.030" | 819 | 6X6 FLAT PLATE |
| 6/3/02 | 1162 | 6/3/02-2 | JM 17-7/8" SQUARE (1-3/8" HOLE) VA | 0.030" | 815 | 6X6 FLAT PLATE |
| 3/19/03 | 1479 | 3/19/03-1 | JM R&R 18" SQ. W/ROLLED CORNERS (1-3/8"HOLE) | 0.035" | 1,108 | 6X6 FLAT PLATE |
| 3/25/03 | 1480 | 3/25/03-1 | JM R&R 18" SQ. W/ROLLED CORNERS (1-3/8"HOLE) | 0.033" | 891 | 6X6 DONUT PLATE |
| 3/25/03 | 1481 | 3/25/03-2 | JM R&R 18" SQ. W/ROLLED CORNERS (1-3/8"HOLE) | 0.033" | 1,008 | 6X6 FLAT PLATE |
| 3/25/03 | 1482 | 3/25/03-3 | JM R&R 18" SQ. W/ROLLED CORNERS (1-3/8"HOLE) | 0.033" | 1,057 | 8X8 DONUT PLATE |
| 3/25/03 | 1483 | 3/25/03-4 | JM R&R 18" SQ. W/ROLLED CORNERS (1-3/8"HOLE) | 0.033" | 1,075 | 8X8 FLAT PLATE |

*FIG.13*

ROOF/RIB PLATE PERFORMANCE
MSHA 14" SPAN TEST

| PLATE DESCRIPTION | MATERIAL GAGE | NOMINAL THICKNESS (IN) | COVERAGE ($IN^2$) | PEAK LOAD (LBS.) |
|---|---|---|---|---|
| JENNMAR (R&R) 18"SQ. PLATE (6X6 SQUARE PLATE) | 20 | 0.034 | 319 | 1,100 |
| JENNMAR (R&R) 18"SQ. PLATE (8X8 SQUARE PLATE) | 20 | 0.035 | 319 | $1,323_1$ |
| | | | | $1,399_2$ |
| JENNMAR (R&R) 18"SQ. PLATE (8X10 RACE TRACK) | 20 | 0.035 | 319 | 1,011 |
| | | | | 1,045 |
| 17"SQ. SPIDER PLATE (6X6 SQUARE PLATE) | 18 | 0.043 | 280 | 500 |
| JENNMAR 19" ROUND PLATE (6X6 SQUARE PLATE) | 20 | 0.034 | 284 | 305 |
| JENNMAR 19" ROUND PLATE (8X8 SQUARE PLATE) | 20 | 0.030 | 284 | $326_1$ |
| | | | | $192_2$ |
| JENNMAR 19" ROUND PLATE (6X10 RACE TRACK) | 20 | 0.030 | 284 | 249 |
| 19" ROUND PLATE (6X6 SQUARE PLATE) | 21 | 0.031 | 284 | 205 |
| JENNMAR 24" ROUND PLATE (6X6 SQUARE PLATE) | 21 | 0.031 | 450 | 410 |

FIG.14

NOTE:

8X8 DONUT PLATE WITH DOUBLE CORNER HANGERS USED.

$RESULTS_1$ HANGERS PARALLEL WITH TEST FIXTURE RISERS.

$RESULTS_2$ HANGERS PERPENDICULAR TO TEST FIXTURE RISERS.

SQUARE EMBOSSED ROOF AND RIB PLATE

CROSS-REFERENCE TO RELATED APPLICATIONS

This application claims the benefit of U.S. Provisional Patent Application Ser. Nos. 60/386,939, filed Jun. 7, 2002, and 60/395,112, filed Jul. 11, 2002.

BACKGROUND OF THE INVENTION

1. Field of the Invention

The present invention generally relates to mine roof and rib supports and, more particularly, to generally square bearing plates used in connection with a mine roof bolt and a primary support member.

2. Description of Related Art

Mine roof and rib (sidewall) control is important for the safety and well being of miners. Surface control is critical to effective roof and rib support systems. Surface control devices with adequate stiffness characteristics can help reduce or even eliminate progressive roof and rib failures. Mine roof and rib controls are typically managed by drilling a bore hole in a mine roof, installing one end of a mine roof bolt in the bore hole, positioning a channel, bearing plate, or mat adjacent to a second end of the mine roof bolt, securing the mine roof bolt in the bore hole, and positioning and tightening the channel plate, bearing plate, or mat to the mine roof or rib strata.

Channel plates, bearing plates, roof channels, and mats help to further stabilize mine roof or rib strata, which may shift over time and can be a visual indicator that the mine roof bolts have been installed correctly. However, due to the seriousness of the safety issues involved with correctly supporting mine roof and rib strata and the increasing risk of injury caused by mine roof falls, further improvements are desirable.

SUMMARY OF THE INVENTION

It is an object of the present invention to provide a mine roof and rib control that overcomes the deficiencies in the prior art. It is another object of the present invention to provide a new mine roof and rib control that is economical, in that it reduces the amount of scrap, provides greater strength than current bearing plates, and is also easy and safe to handle, bundle, and install.

The present invention is directed to a mine roof and rib support system and apparatus and generally includes a square bearing plate, which may be used in conjunction with primary and supplemental roof bolts along with rib support. The square bearing plate defines a through hole positioned near a center portion of the square bearing plate and includes a peripheral section, which at least partially circumscribes the bearing plate. In between the through hole and the peripheral section is a rib member area. The rib member area preferably includes two rib members with a convex cross-section connected by a substantially linear surface member disposed between the two rib members. In a further embodiment of the present invention, the rib member area includes two or more concave ribs with a substantially linear surface member disposed between the two rib members. In a further embodiment of the present invention, the rib member area includes two substantially linear surfaces connected by a convex rib member. The square bearing plate also includes a safety edge where an edge of the peripheral section has been rolled, looped, folded, or otherwise similarly formed.

These and other advantages of the present invention will be clarified in the detailed description of the preferred embodiments taken together with the attached drawings in which like reference numerals represent like elements throughout.

BRIEF DESCRIPTION OF THE DRAWINGS

FIG. 13 is a summary chart of tests performed on various embodiments of a mine roof and rib support system of the present invention;

FIG. 14 is a summary chart of tests performed on various embodiments of a mine roof and rib support system of the present invention and conventional systems;

DESCRIPTION OF THE PREFERRED EMBODIMENTS

Figure 1:
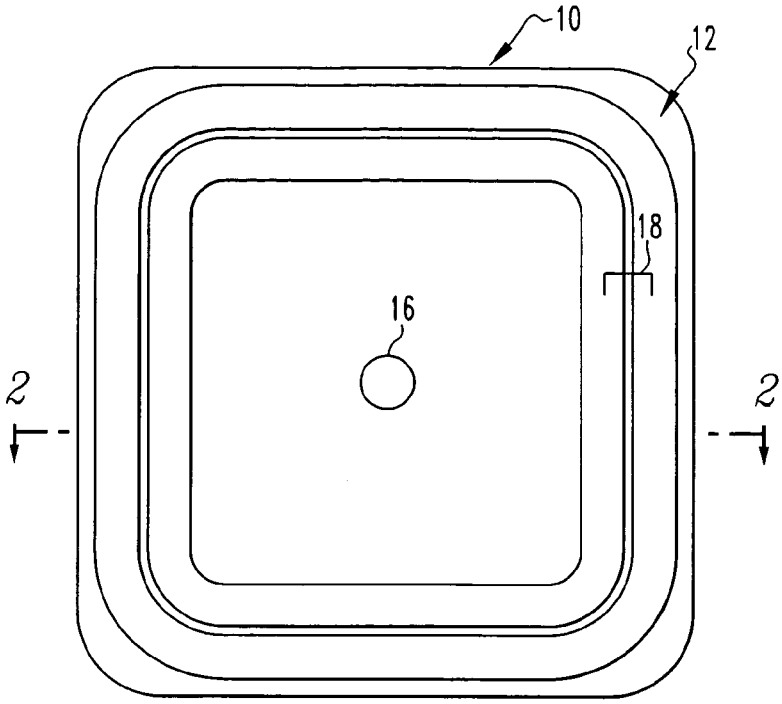
FIG. 1 is a top view of a mine roof and rib support system according to the present invention.
Figure 2:
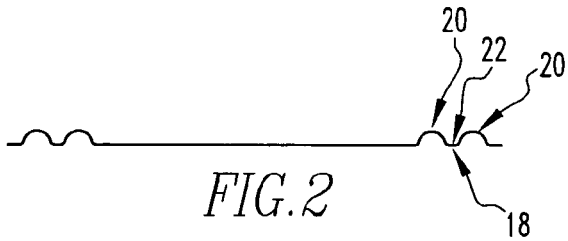
FIG. 2 is a cross-sectional view taken along line 2-2 of the mine roof and rib support system shown in FIG. 1.

A square bearing plate 10 according to one embodiment of the present invention is shown in FIGS. 1 and 2. The first embodiment square bearing plate 10 is preferably commercial grade steel. The first embodiment square bearing plate 10 generally defines a square shape, a peripheral section 12, and a through hole 16 that is positioned in a center portion of the square bearing plate 10. In this embodiment, the square bearing plate 10 includes a rib member area 18 positioned between the through hole 16 and the peripheral section 12. The rib member area 18 includes two or more rib members 20 with convex cross-sections connected by one or more substantially linear surface member 22 between the two rib members 20. The preferred form of the roof and rib support system has two ribs to provide improved strength and stability.

Figure 4:
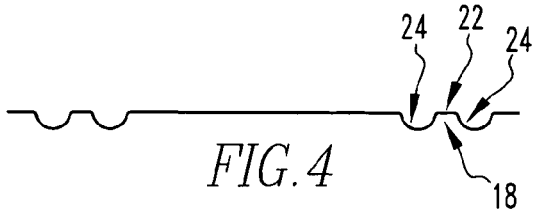
FIG. 4 is a cross-sectional view taken along line 4-4 of a second embodiment of the mine roof and rib support system shown in FIG. 3.
Figure 3:
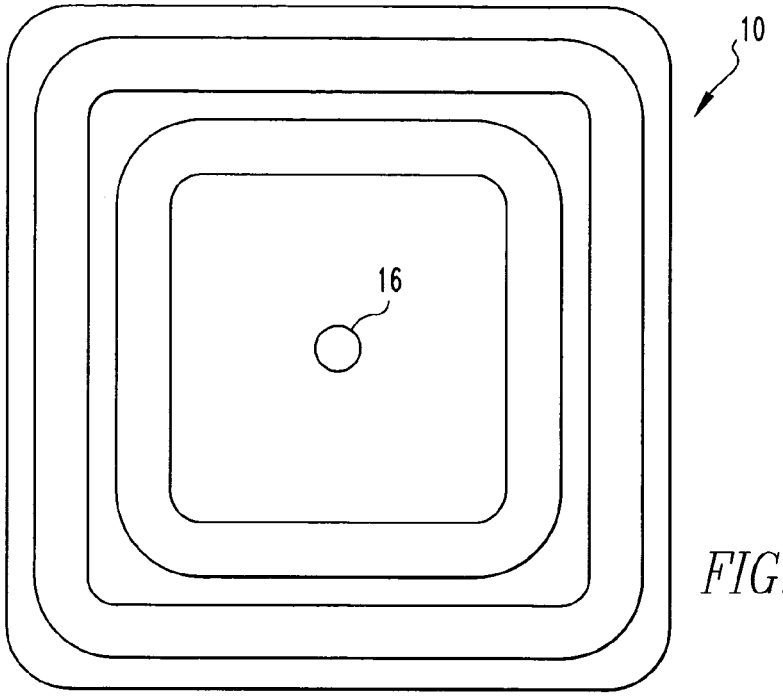
FIG. 3 is a top view of a second embodiment mine roof and rib support system according to the present invention.

A square bearing plate 10 according to a second embodiment of the present invention is shown in FIGS. 3 and 4. In this embodiment, the square bearing plate 10 is similar to the first embodiment square bearing plate 10, with like reference numerals indicating like parts. The second embodiment bearing plate 10 also includes the through hole 16, the peripheral section 12, and two or more rib member areas 18. The rib member area 18 in the second embodiment is different from that in the first embodiment, the rib members 24 are concave instead of convex.

Figure 6:
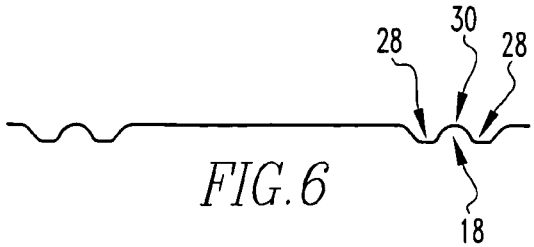
FIG. 6 is a cross-sectional view taken along line 6-6 of a third embodiment of the mine roof and rib support system shown in FIG. 5.
Figure 5:
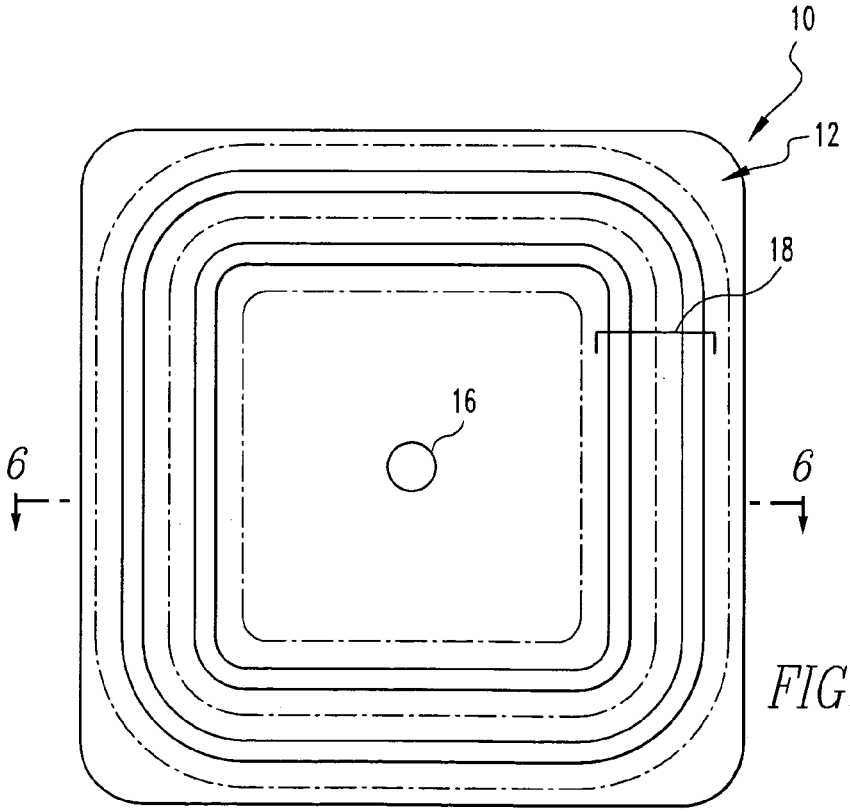
FIG. 5 is a top view of a third embodiment mine roof and rib support system according to the present invention.
Figure 7:
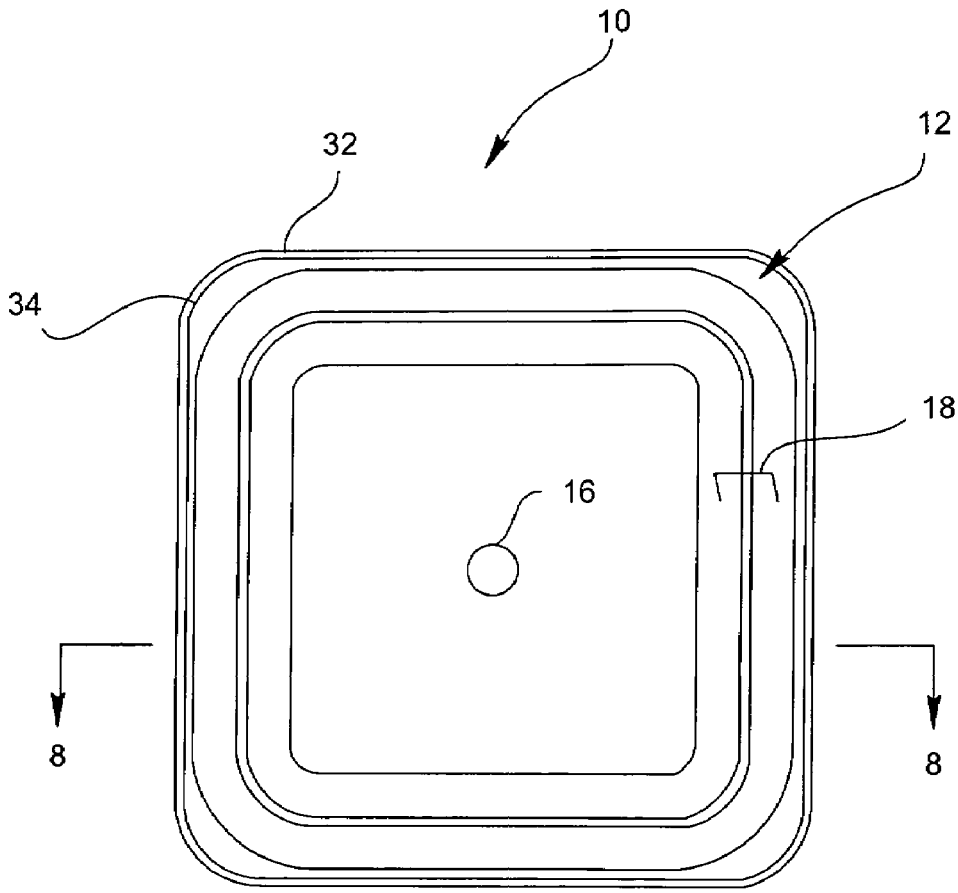
FIG. 7 is a top view of a mine roof and rib support system according to the present invention having a safety edge.
Figure 8:
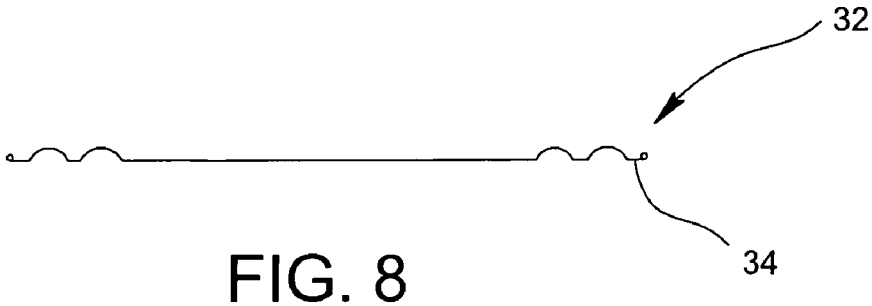
FIG. 8 is a cross-sectional view taken along line 8-8 of the mine roof and rib support system shown in FIG. 7.
Figure 9:
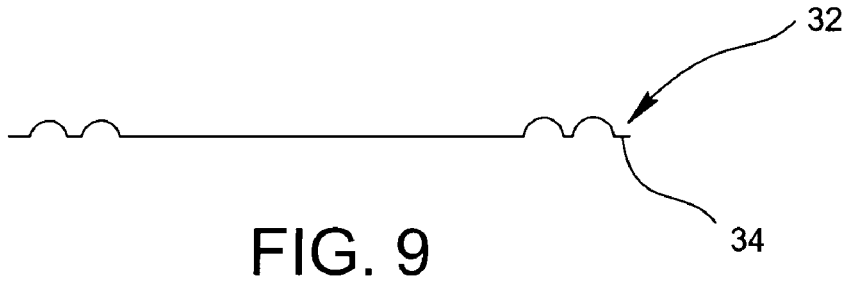
FIG. 9 is a cross-sectional view taken along line 8-8 of a second embodiment of the mine roof and rib support system shown in FIG. 5.

A square bearing plate 10 according to a third embodiment of the present invention is shown in FIGS. 5 and 6. The third embodiment square bearing plate 10 is similar to both the first and second embodiment square bearing plates 10, with like reference numerals indicating like parts. The third embodiment square bearing plate 10 includes the through hole 16, the peripheral section 12, and the rib member area 18. However, the rib member area 18 in the third embodiment is different from that in the first or second embodiment in that the rib member area 18 includes two or more linear surfaces 28 connected by at least one convex rib member 30.

Figure 10:
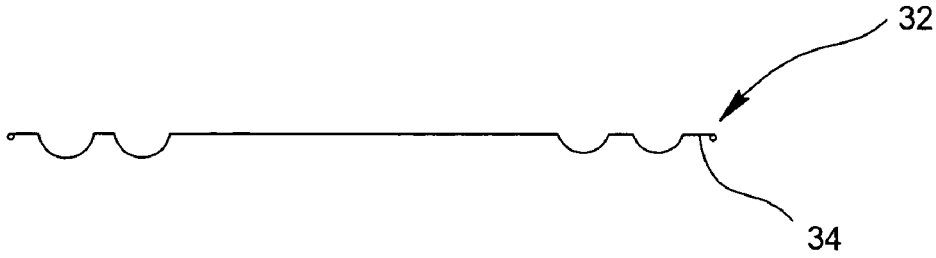
FIG. 10 is a cross-sectional view taken along line 8-8 of a third embodiment of the mine roof and rib support system shown in FIG. 5.
Figure 11:
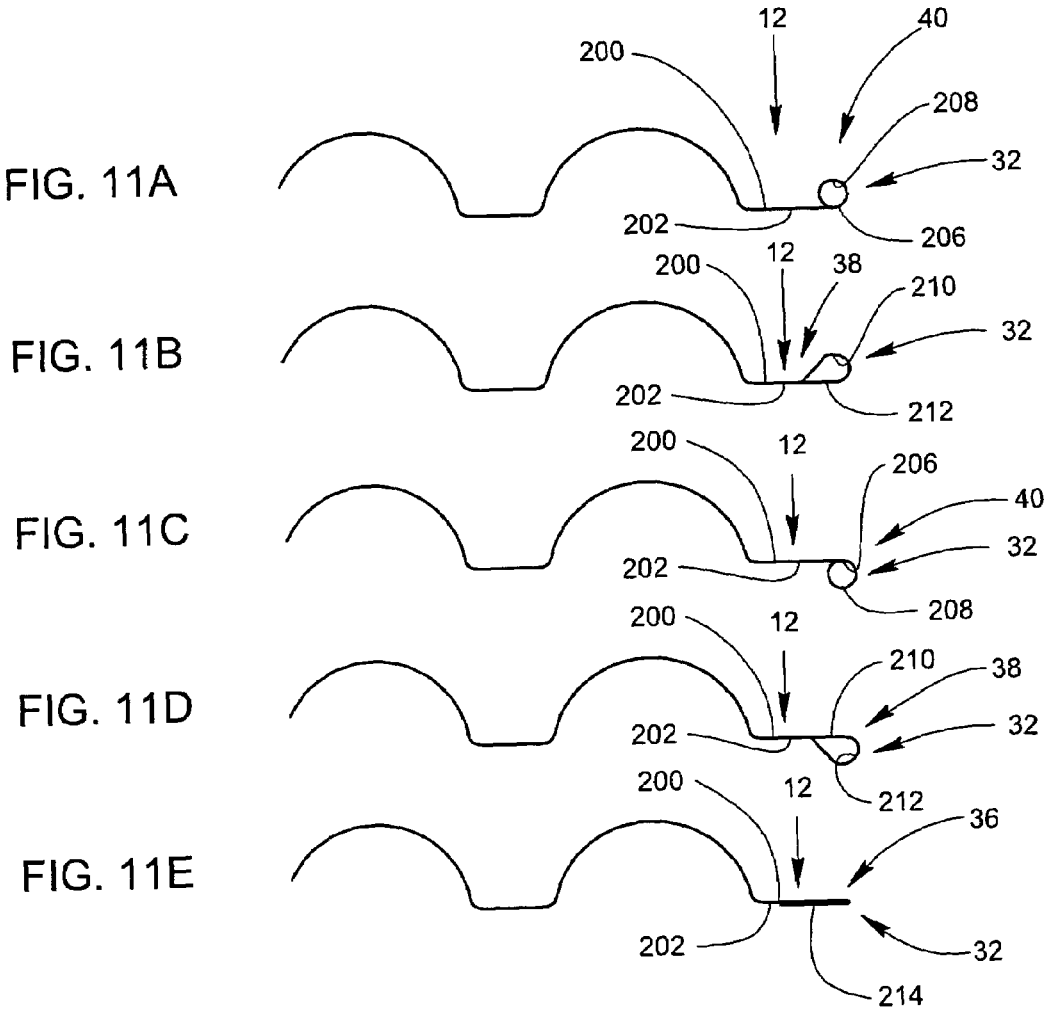
FIG. 11 is partial cross-sectional views of alternative safety edges designated by the letters A through E of the mine roof and rib support system shown in FIG. 5.

FIGS. 7-11 show mine roof and rib support system embodiments forming a safety edge 32 around the peripheral section 12. For example, FIGS. 10 and 11 show ends which are doubled over upon themselves (or folded) 36 (FIG. 11E), looped 38 (FIGS. 11B and 11D), or otherwise rolled or curled 40 (FIGS. 11A and 11C), for example, approximately 180 to 360°, toward an inside surface of the plate 10. It has been found that any of these safety edge 32 configurations help to prevent injury from sharp edges, add additional strength to the outer periphery of the plates 10, and also aid in the stacking and destacking of the plates 10.

Figure 12:
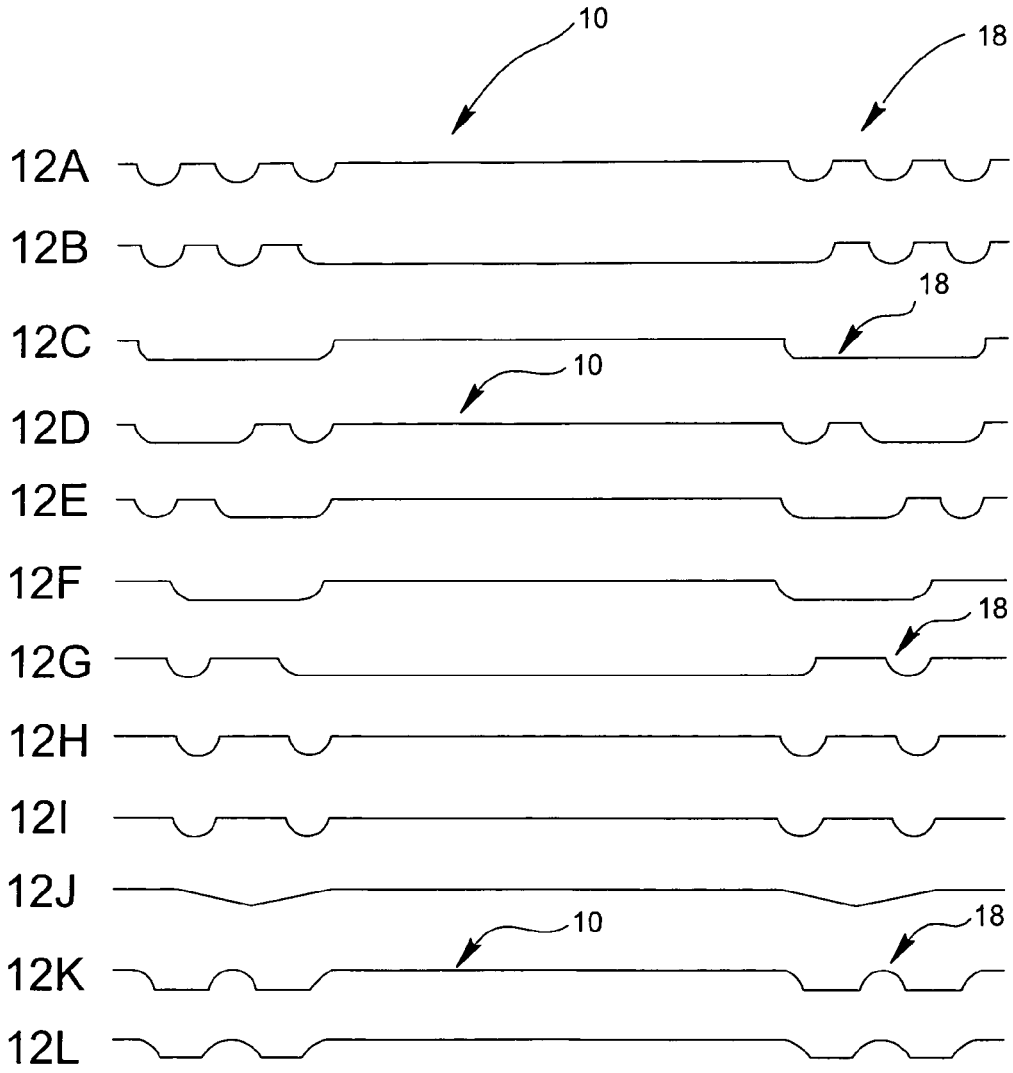
FIG. 12 is cross-sectional views of alternative embodiments designated by the letters A through L of rib member areas of a mine roof and rib support system according to the present invention.

FIG. 12 illustrates different possible designs FIGS. 12A-12L of the rib member area 18 and the resulting calculated moments of inertia. These tests were used to establish the desired first embodiment that provides the greatest possible strength. Using the established preferred design of the rib member area 18, FIGS. 12A, 12C, 12G, and 12K illustrates a preferred design of the square bearing plate 10 that will provide the greatest strength, yet will allow for a surface area large enough to allow for a 6×6, 8×8, or 6×10 primary support plate, or a substantially similar size elliptical primary support plate to be used in conjunction therewith.

Any of the aforementioned embodiments are designed to be used with a mine roof bolt to provide mine roof and rib support. Dome-shaped, donut-shaped, flat, or other suitably-shaped mine roof and rib support plates may also be used in conjunction with the square bearing plates 10 according to any of the embodiments of the present invention and a mine roof bolt. The support system may also be used with mine prop supports to increase surface control of the immediate roof surface. Multiple plates may be stacked and used where extra strength is required.

When used on the roof, the plates 10 assist to prevent various forms of roof collapse. When used on the ribs (sidewalls), the plates 10 assist to prevent rib roll, which is a condition where portions of the rib break out and can endanger the miners. The plates 10 may also be used at track entryways. Because of these various advantages, the system can be used in various mining operations, such as in coal mining with roof bolts (including cable bolts) or in hard rock mining with friction lock devices.

A test frame set was used to evaluate the performance of the square bearing plates 10 and conventional plates. The test consisted of applying a load to the center of the plate 10. Peak load measurements were measured and recorded during these tests. The load-bearing results are summarized in FIGS. 13 and 14. The results show that the square bearing plate 10 can withstand greater loads than conventional bearing plates with minimal deflection.

The forming of a square bearing plate 10 of the first or second embodiment from a steel strip or sheet has less scrap per piece, yet will cover more surface area, as compared to conventional round bearing plates. This is considered to be one of the greatest advantages of the present invention, in that it provides greater strength at a cheaper cost based on the reduced amount of scrap per piece.

Figure 15:
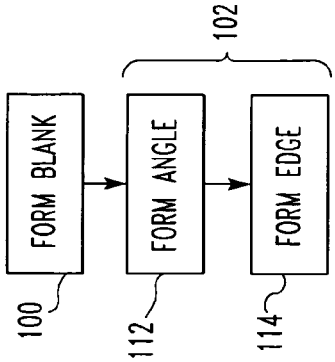
FIG. 15 is a flowchart illustration of a method of making a mine roof and rib support system according to the present invention.
Figure 16:
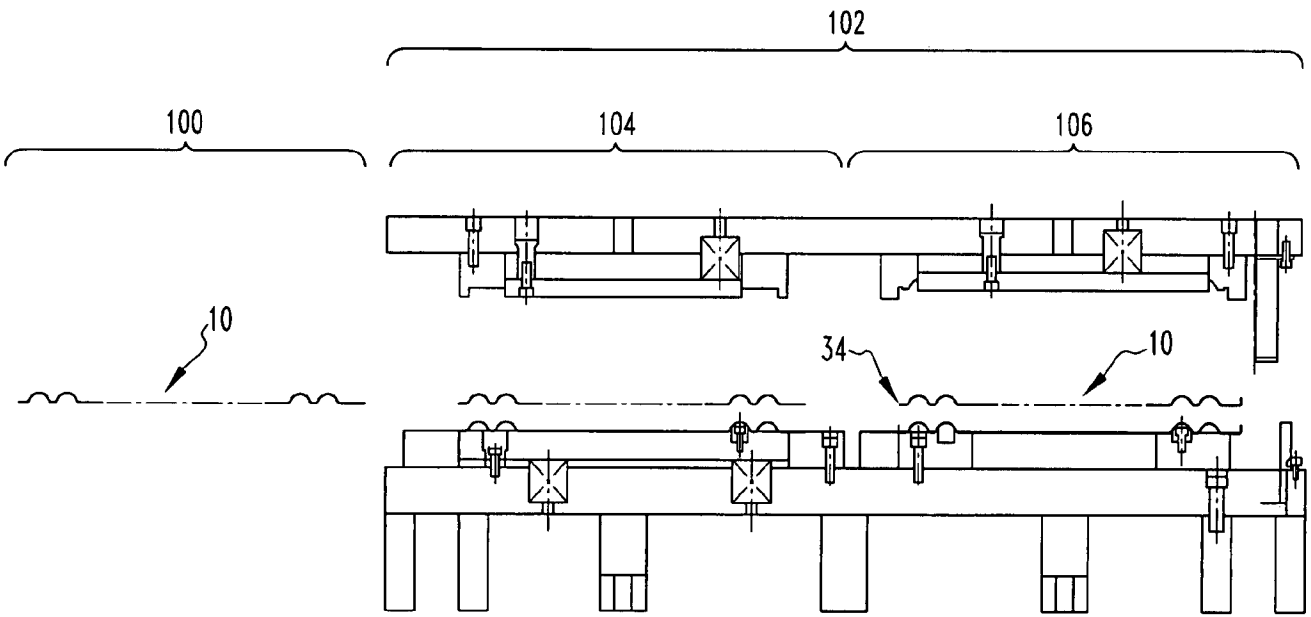
FIG. 16 is a side view illustration of equipment to form a safety edge on a mine roof and rib support system of the present invention.

Referring to FIGS. 15 and 16, in a method of making a mine roof support system according to the present invention, in a first operation 100, a blank (the square bearing plate 10) is formed from raw material, for example, sheet or strip steel. The blank includes the through hole 16, the peripheral section 12, and the rib member area 18. In a second operation 102, the safety edge 32 is formed around the peripheral section 12 of the blank (square bearing plate 10). The first operation 100 is preferably a one-step operation performed by, for example, a first die assembly.

Preferably, the second operation 102 is a two-step operation performed by, for example, a second die assembly 104 and a third die assembly 106. First 112, the edge 34 of the peripheral section 12 is deformed to form an angle, for example, of approximately 90°. Second 114, the now angled edge 34 is again deformed to create the safety edge 32 (see FIGS. 7-11). This second deformation can result in a rolled edge (FIGS. 11A and 11C), a curled edge (FIGS. 11A and 11C), a looped edge (FIGS. 11B and 11D), a folded edge (FIG. 11E), etc. More particularly and with reference to FIG. 11A, the peripheral edge 12 of the plate 10 (see also FIG. 7) has first or upper surface 200 and opposite second or lower surface 202. With reference to FIG. 11A, at the safety edge 32, the rolled edge 40 has surface portions 206 and 208 of the first and second surfaces 200 and 202, respectively, rolled such that the surface portion 206 of the first surface 200 provides inner surface of the rolled edge 40, and the surface portion 208 of the second surface 202 provides outer surface of the rolled edge 40. With reference to FIG. 11C, at the safety edge 32, the rolled edge 40 has the surface portions 206 and 208 of the first and second surfaces 200 and 202, respectively, rolled such that the surface portion 206 of the first surface 200 provides outer surface of the rolled edge 40, and the surface portion 208 of the second surface 202 provides inner surface of the rolled edge 40. With reference to FIG. 11B, at the safety edge 32, the looped edge 38 has surface portions 210 and 212 of the first and second surfaces 200 and 202, respectively, looped such that the surface portion 210 of the first surface 200 provides inner surface of the looped edge 38, and the surface portion 212 of the second surface 202 provides outer surface of the looped edge 38. With reference to FIG. 11D, at the safety edge 32, the looped edge 38 has the surface portions 210 and 212 of the first and second surfaces 200 and 202, respectively, looped such that the surface portion 210 of the first surface 200 provides outer surface of the looped edge 38, and the surface portion 212 of the second surface 202 provides outer surface of the looped edge 38. With reference to FIG. 11E, at the safety edge 32, the folded edge 36 has the surface portion 214 of the first surface 200 providing outer surface of the folded edge 36.

The invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. In a mine roof support system of the type having a bearing plate, a mine roof bolt passing through the bearing plate and one end of the roof bolt securely mounted in bore hole in the mine roof, wherein the mine roof bolt positions the bearing plate to the mine roof, the improvement comprising:

the bearing plate, comprising:

a first major surface;

an opposite second major surface;

end connecting the first and second major surfaces, the end positioned over one of the major surfaces, and spaced from the perimeter of the bearing plate; and a hole in center portion of the bearing plate and extending through the first and second major surfaces of the bearing plate, wherein the mine roof bolt is received through the hole; and at least one rib member area disposed between the hole and the perimeter and circumscribing the hole, wherein the at least one rib member area comprises:

at least one continuous rib member circumscribing the hole and a flat continuous surface area defined as a linear surface member circumscribing the rib member.

2. The mine roof support system according to claim 1, wherein the at least one rib member area includes two rib members, wherein each of the rib members circumscribes the hole and one of the rib members circumscribes the other one of the rib members and the linear surface member is between and separates the two rib members.

3. The mine roof support system according to claim 2, wherein each of the two rib members has a convex cross-sectional shape.

4. The mine roof support system according to claim 2, wherein each of the two rib members has a concave cross-sectional shape.

5. The mine roof support system according to claim 1, wherein the linear surface member is a first linear surface member and the at least one rib member area includes a second linear surface member circumscribing the hole, wherein the rib member circumscribes the second linear surface member.

6. The mine roof support system according to claim 5, wherein the rib member has a convex cross-sectional shape.

7. The mine roof support system according to claim 1, wherein the end over one of the major surfaces and spaced from the perimeter of the bearing plate comprises a continuous safety edge formed around the perimeter of the bearing plate, the safety edge selected from the group consisting of a rolled safety edge, a looped safety edge, and a folded safety edge.

8. The mine roof support system according to claim 7, wherein the continuous safety edge is a looped safety edge and the first major surface at the safety edge has a surface portion and the second major surface at the safety edge has a surface portion, wherein the surface portion of the first major surface provides inner surface of the looped edge and the surface portion of the second major surface provides outer surface of the looped portion, and the end faces the surface portion of the second major surface adjacent the perimeter of the bearing plate.

9. The mine roof support system according to claim 7, wherein the continuous safety edge is a looped safety edge and the first major surface at the safety edge has a surface portion and the second major surface at the safety edge has a surface portion, wherein the surface portion of the first major surface provides outer surface of the looped edge and the surface portion of the second major surface provides inner surface of the looped portion, and the end faces the surface portion of the first major surface adjacent the perimeter of the bearing plate.

10. The mine roof support system according to claim 2, wherein the end over one of the major surfaces and spaced from the perimeter of the bearing plate comprises a continuous safety edge formed around the perimeter of the bearing plate, the safety edge selected from the group consisting of a rolled safety edge, a looped safety edge, and a folded safety edge.

11. The mine roof support system according to claim 10, wherein the continuous safety edge is a looped safety edge and the first major surface at the safety edge has a surface portion and the second major surface at the safety edge has a surface portion, wherein the surface portion of the first major surface provides inner surface of the looped edge and the surface portion of the second major surface provides outer surface of the looped portion, and the end faces the surface portion of the second major surface adjacent the perimeter of the bearing plate.

12. The mine roof support system according to claim 10, wherein the continuous safety edge is a looped safety edge and the first major surface at the safety edge has a surface portion and the second major surface at the safety edge has a surface portion, wherein the surface portion of the first major surface provides outer surface of the looped edge and the surface portion of the second major surface provides inner surface of the looped portion, and the end faces the surface portion of the first surface adjacent the perimeter of the bearing plate.

13. The mine roof support system according to claim 5, wherein the end over one of the major surfaces and spaced from the perimeter of the bearing plate comprises a continuous safety edge formed around the perimeter of the bearing plate, the safety edge selected from the group consisting of a rolled safety edge, a looped safety edge, and a folded safety edge.

14. The mine roof support system according to claim 13, wherein the continuous safety edge is a looped safety edge and the first major surface at the safety edge has a surface portion and the second major surface at the safety edge has a surface portion, wherein the surface portion of the first major surface provides inner surface of the looped edge and the surface portion of the second major surface provides outer surface of the looped portion, and the end faces the surface portion of the second major surface adjacent the perimeter of the bearing plate.

15. The mine roof support system according to claim 13, wherein the continuous safety edge is a looped safety edge and the first major surface at the safety edge has a surface portion and the second major surface at the safety edge has a surface portion, wherein the surface portion of the first major surface provides outer surface of the looped edge and the surface portion of the second major surface provides inner surface of the looped portion, and the end faces the surface portion of the first major surface adjacent the perimeter of the bearing plate.

16. In a mine roof support system of the type having a bearing plate, a mine roof bolt passing through the bearing plate and having one end of the roof bolt securely mounted in bore hole in the mine roof, wherein the mine roof bolt positions the bearing plate to the mine roof, the improvement comprising:

the bearing plate comprising:

a first major surface;

an opposite second major surface;

an end connecting the first and second major surfaces, the end positioned over one of the major surfaces and spaced from the perimeter of the bearing plate to provide a safety edge formed around the perimeter of the bearing plate; and a hole in center portion of the bearing plate and extending through the first and second major surfaces of the bearing plate, wherein the mine roof bolt is received through the hole.

17. The mine roof support system according to claim 16 wherein, the safety edge is selected from the group consisting of a rolled safety edge, a looped safety edge, and a folded safety edge.

18. The mine roof support system according to claim 17, wherein the safety edge is a rolled safety edge and the first major surface at the safety edge has a surface portion and the second major surface at the safety edge has a surface portion, wherein the surface portion of the first major surface provides inner surface of the rolled edge and the surface portion of the second major surface provides outer surface of the rolled portion, and the end faces the surface portion of the first major surface.

19. The mine roof support system according to claim 17, wherein the safety edge is a looped safety edge and the first major surface at the safety edge has a surface portion and the second maj or surface at the safety edge has a surface portion, wherein the surface portion of the first major surface provides inner surface of the looped edge and the surface portion of the second maj or surface provides outer surface of the looped portion, and the end faces the surface portion of the second major surface adjacent the perimeter of the bearing plate.

20. The mine roof support system according to claim 17, wherein the safety edge is a looped safety edge and the first major surface at the safety edge has a surface portion and the second major surface at the safety edge has a surface portion, wherein the surface portion of the first major surface provides outer surface of the looped edge and the surface portion of the second major surface provides inner surface of the looped portion, and the end faces the surface portion of the first major surface adjacent the perimeter of the bearing plate.

21. The mine roof support system according to claim 17, wherein the safety edge is a folded safety edge and the first major surface at the safety edge has a surface portion having a first segment and a second segment, and the second major surface at the safety edge has a surface portion having a first segment and a second segment, wherein the first segment of the surface portion of the first major surface faces in an opposite direction to the second segment of the surface portion of the first major surface, and the first segment of the surface portion of the second major surface is in facing relationship to the second segment of the surface portion of the second major surface.

* * * * *